US007510821B2

(12) United States Patent
Soejima et al.

(10) Patent No.: US 7,510,821 B2
(45) Date of Patent: Mar. 31, 2009

(54) SILVER HALIDE PHOTOGRAPHIC LIGHT-SENSITIVE MATERIAL FOR MOVIE SUBTITLES

(75) Inventors: Shin Soejima, Kanagawa (JP); Shinichi Teramae, Kanagawa (JP); Hiroshige Nakamura, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/875,467

(22) Filed: Oct. 19, 2007

(65) Prior Publication Data

US 2008/0096144 A1 Apr. 24, 2008

(30) Foreign Application Priority Data

Oct. 20, 2006 (JP) ..... P2006-286911

(51) Int. Cl.

| | |
|---|---|
| ***G03C 1/76*** | (2006.01) |
| ***G03C 1/85*** | (2006.01) |
| ***G03C 1/00*** | (2006.01) |
| ***G03C 3/00*** | (2006.01) |

(52) U.S. Cl. ..... 430/523; 430/527; 430/631; 430/495.1; 430/496; 430/934

(58) Field of Classification Search ..... 430/523, 430/527, 631, 495.1, 496, 934, 49
See application file for complete search history.

(56) References Cited

U.S. PATENT DOCUMENTS

2008/0069588 A1* 3/2008 Inaba et al. ..... 399/116

FOREIGN PATENT DOCUMENTS

JP 7-128779 A 5/1995

* cited by examiner

*Primary Examiner*—Geraldina Visconti
(74) *Attorney, Agent, or Firm*—Birch, Stewart, Kolasch & Birch, LLP

(57) ABSTRACT

A silver halide photographic light-sensitive material for movie subtitles, includes: a transparent support; and at least one light-sensitive layer and at least one light-insensitive layer, directly or indirectly on the transparent support, wherein the at least one light-insensitive layer comprises at least one kind of a silicone oil.

10 Claims, No Drawings

SILVER HALIDE PHOTOGRAPHIC LIGHT-SENSITIVE MATERIAL FOR MOVIE SUBTITLES

BACKGROUND OF THE INVENTION

1. Field of the Invention

The present invention relates to a silver halide photographic light-sensitive material, particularly, a silver halide photographic light-sensitive material for the preparation of movie subtitles. Furthermore, the present invention relates to a light-sensitive material for the preparation of subtitles, which is assured of excellent durability not allowing for reflection of scratches at the preparation of a cinematic positive print.

2. Description of the Related Art

The movie, which is an application of silver halide photographic technology, is a method of photographing an object usually at a rate of 24 sheets per 1 second, and sequentially projecting the obtained still images at the same rate as that on photographing, thereby reproducing a moving image. This method is built on the silver halide photographic technology which is being continuously improved over one hundred years or more, and the pictorial quality is by far higher as compared with other methods for reproducing a moving image. Large screen filmmaking is facilitated by virtue of the high pictorial quality, and this allows a large number of people to watch a moving image at the same time. Accordingly, there are established many theaters having equipment for cinema projection on a large screen and having a seating capacity of a large number of people, such as movie theater. However, recent rapid development of electronic technology and information processing technology has come to propose alternate means ensuring the comparable pictorial quality based on the digital image processing technology for all filmmaking processes from photographing to projection through cutting. Such a technique built on the digital image processing technology is characterized in that an image can be easily handled by virtue of the progress of a computer and good reproducibility is obtained because the digital signal less deteriorates. To match this techniques the movie based on the silver halide photographic technology is demanded to realize easy handling and stability while maintaining its original high pictorial quality, particularly, easy handling and stability at the processing station, such as stability against fluctuation during storage or in the development processing solution.

One of factors for realizing the easy handling and stability while maintaining high pictorial quality is scratch resistance at the continuous exposure and development processing in a large amount. The method for adding subtitles which are inserted into a cinematic positive light-sensitive material is diversified. There are various methods such as a method of contact-exposing picture information of a movie through an intermediate and then shaving off the light-sensitive material by using a laser, and a method of printing the textual information on the picture information-containing intermediate itself. Among these, a method of exposing superposed three sheets, that is, a black-and-white light-sensitive material having formed thereon subtitles in black letters, a picture information intermediate, and a cinematic positive light-sensitive material, is most frequently employed. According to this method, a cinematic positive light-sensitive material with multilingual subtitles can be prepared for the same picture information.

The light-sensitive material for movie subtitles works out to an original plate for enlarging and projecting a small-size character and therefore, the performance required is to give excellent sharpness and high-density coloration. Particularly, in view of quality requirement for sharpness, the formulation design can be made based on the formulation analogue to that of the microfilm light-sensitive material. Details of the microfilm formulation are described in JP-A-7-128779 (the term "JP-A" as used herein means an "unexamined published Japanese patent application"). However, this light-sensitive material is, if directly applied to the cinematic print, susceptible to scratches or the like at the high-speed exposure and known to have a problem in the durability. Furthermore, a density sufficiently high to extract characters is lacking, and the density as well as slipperiness are in a level in need of improvement.

SUMMARY OF THE INVENTION

An object of the present invention is to solve the problems in those conventional techniques. That is, an object of the present invention is to provide a silver halide light-sensitive material for movie subtitles, which is assured of excellent durability not allowing for reflection of scratches at the preparation of a cinematic positive print.

As a result of intensive studies to attain the above-described object, the present inventors have found that the composition of the oil-soluble portion in the overcoat layer is important in preparing a silver halide light-sensitive material for movie subtitles, which is assured of excellent durability not allowing for reflection of scratches at the preparation of a cinematic positive print, and a great improvement effect can be confirmed by using a specific compound.

The means for attaining the above-described object is as follows.

(1) A silver halide photographic light-sensitive material for movie subtitles, comprising:

a transparent support; and at least one light-sensitive layer and at least one light-insensitive layer, directly or indirectly on the transparent support, wherein the at least one light-insensitive layer comprises at least one kind of a silicone oil.

(2) The silver halide photographic light-sensitive material as described in (1) above, wherein the silicone oil is a non-reactive silicone oil.

(3) The silver halide photographic light-sensitive material as described in (2) above, wherein the non-reactive silicone oil is a straight silicone oil.

(4) The silver halide photographic light-sensitive material as described in (3) above, wherein the straight silicone oil is at least one of a dimethyl silicone oil represented by formula (A) and a methylphenyl silicone oil represented by formula (B):

Formula (A):

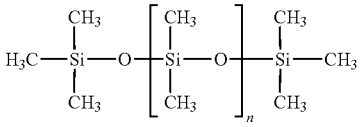

-continued

Formula (B):

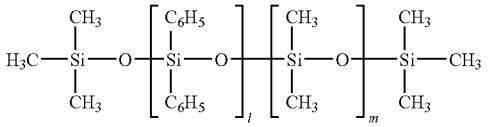

wherein n represents an integer of 1 or more; and l and m each independently represents an integer of 1 or more.

(5) The silver halide photographic light-sensitive material as described in (4) above, wherein the straight silicone oil is the dimethyl silicone oil represented by formula (A).

(6) The silver halide photographic light-sensitive material as described in any of (1) to (5) above, wherein a coated amount of the silicone oil is from 5 to 50 mg/m$^2$.

(7) The silver halide photographic light-sensitive material as described in (6) above, wherein the coated amount of the silicone oil is from 5 to 30 mg/m$^2$.

(8) The silver halide photographic light-sensitive material as described in (7) above, wherein the coated amount of the silicone oil is from 5 to 25 mg/m$^2$.

(9) The silver halide photographic light-sensitive material as described in any of (1) to (8) above, which has a total coated silver amount of from 1.70 to 2.50 g/m$^2$.

(10) The silver halide photographic light-sensitive material as described in any of (1) to (9) above, wherein the at least one light-insensitive layer comprising at least one kind of a silicone oil is a protective layer.

DETAILED DESCRIPTION OF THE INVENTION

The silicone oil is described in detail below. With respect to the silicone oil as a lubricant, a straight silicone oil, a modified silicone oil or a cured product thereof can be used. The straight silicone oil includes dimethyl silicone oil, methylphenyl silicone oil and methyl hydrogen silicone oil. Examples of the dimethyl silicone oil include KF96-10, KF96-100, KF96-1000, KF96H-10000, KF96H-12500 and KF96H-100000 (all trade names, produced by Shin-Etsu Chemical Co., Ltd.), and examples of the methyl phenyl silicone oil include KF50-100, KF54 and KF56 (all trade names, produced by Shin-Etsu Chemical Co., Ltd.).

The modified silicone oil can be classified into a reactive silicone oil and a non-reactive silicone oil. The reactive silicone oil includes, in addition to an amino-modified silicon oil and an epoxy-modified silicon oil of the present invention, carboxyl-modified, hydroxy-modified, methacryl-modified, mercapto-modified, phenol-modified or one-terminal reactive/hetero-functional group-modified silicone oils. Examples of the carboxyl-modified silicone oil include X-22-162C (trade name, produced by Shin-Etsu Chemical Co., Ltd.); examples of the hydroxy-modified silicone oil include X-22-160AS, KF-6001, KF-6002, KF-6003, X-22-170DX, X-22-176DX, X-22-176D and X-22-176DF (all trade names, produced by Shin-Etsu Chemical Co., Ltd.); and examples of the methacryl-modified silicone oil include X-22-164A, X-22-164C, X-24-8201, X-22-174D and X-22-2426 (all trade names, produced by Shin-Etsu Chemical Co., Ltd.).

The reactive silicone oil may be used by curing it and can be classified into, for example, a reaction-curable type, photocurable type and catalyst-curable type. Among these, the reaction-curable silicone oil is preferred. A reaction-curable silicone oil obtained by reacting an amino-modified silicone oil with an epoxy-modified silicone oil and curing the reactant is preferred. Examples of the catalyst-curable or photocurable silicone oil include KS-705F-PS, KS-705F-PS-1 and KS-770-PL-3 [catalyst-curable silicone oil; all trade names, produced by Shin-Etsu Chemical Co., Ltd.]; and KS-720 and KS-774-PL-3 [photocurable silicone oil; both trade names, produced by Shin-Etsu Chemical Co., Ltd.]. The amount of the curable silicone oil added is preferably from 0.5 to 30 mass % based on the resin constituting the receiving layer. The releasing agent is used in an amount of 2 to 4 mass %, preferably from 2 to 3 mass %, per 100 parts by mass of the polyester resin. (In this specification, mass ratio is equal to weight ratio.)

The non-reactive silicone oil includes, for example, polyether-modified, methylstyryl-modified, alkyl-modified, higher fatty acid ester-modified, hydrophilic special-modified, higher alkoxy-modified and fluorine-modified silicone oils. Examples of the polyether-modified silicone oil include KF-6012 (trade name, produced by Shin-Etsu Chemical Co., Ltd.), and examples of the methylstyryl-modified silicone oil include 24-510 and KF41-410 (both trade names, produced by Shin-Etsu Chemical Co., Ltd.). A modified silicone represented by any one of the following formulae 1 to 3 may also be used.

Formula 1:

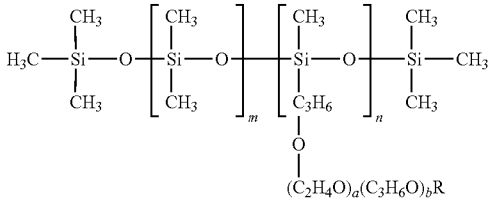

In formula 1, R represents a hydrogen atom or a linear or branched alkyl group which may be substituted by an aryl group or a cycloalkyl group, m and n each represents an integer of 2,000 or less, and a and b each represents an integer of 30 or less.

Formula 2:

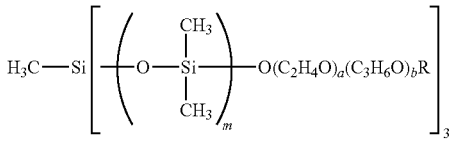

In formula 2, R represents a hydrogen atom or a linear or branched alkyl group which may be substituted by an aryl group or a cycloalkyl group, m represents an integer of 2,000 or less, and a and b each represents an integer of 30 or less.

Formula 3:

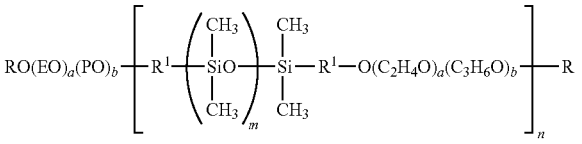

In formula 3, R represents a hydrogen atom or a linear or branched alkyl group which may be substituted by an aryl group or a cycloalkyl group, m and n each represents an integer of 2,000 or less, a and b each represents an integer of 30 or less, $R^1$ represents a single bond or a divalent linking group, E represents an ethylene group which may have a substituent, and P represents a propylene group which may have a substituent.

Such silicone oils are described in Silicone Handbook, The Nikkan Kogyo Shinbun, Ltd., and as for the curling technique of curable silicone oil, the techniques described in JP-A-8-108636 and JP-A-2002-264543 may be preferably used.

Above all, the silicone oil is preferably a non-reactive silicone oil, more preferably a straight silicone oil. Among the straight silicone oils, still more preferred are a dimethyl silicone oil represented by formula (A) and a methylphenyl silicone oil represented by formula (B).

Formula (A):

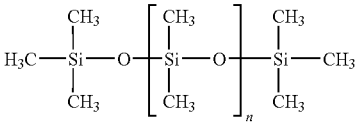

wherein n represents an integer of 1 or more,

Formula (B):

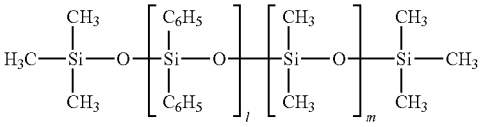

wherein l and m each independently represents an integer of 1 or more.

Among these silicone oils, dimethyl silicone oil is preferred, more specifically, KF96-10 and KF96-100 are preferred, and KF-96-10 is most preferred.

The coated amount of the silicone oil is preferably from 5 to 50 mg/m$^2$, more preferably from 5 to 30 mg/m$^2$, still more preferably from 5 to 25 mg/m$^2$.

The total silver coated amount in the light-sensitive material is preferably from 1.70 to 2.50 g/m$^2$, more preferably from 2.00 to 2.50 g/m$^2$, still more preferably from 2.10 to 2.40 g/m$^2$.

In the silver halide photographic light-sensitive material having at least one light-sensitive silver halide emulsion layer, the silver halide emulsion is preferably spectrally sensitized with a compound described in JP-A-7-128779, from page 2, line 33 to page 26, line 20, more preferably with Compound I-7.

In the silver halide photographic emulsion for use in the present invention, any of silver bromide, silver iodobromide, silver iodochlorobromide, silver chlorobromide and silver chloride may be used as the silver halide. Also, the silver halide grain may have any crystalline phase. The silver halide emulsion may be an emulsion of tabular grains having a thickness of 0.5 μm or less, preferably 0.3 μm or less, and a diameter of 0.6 μm or more, in which grains having an average aspect ratio of 5 or more occupy 50% or more of the entire projected area, or may also be a monodisperse emulsion in which grains having a grain size within ±40% of the average grain size occupy 95% or more by number of all grains. The silver halide grain may be different in the phase between the inside and the surface layer or may have a homogeneous phase. Furthermore, the silver halide grain may be a grain where a latent image is formed mainly on the surface (for example, a negative emulsion), or a grain where a latent image is formed mainly inside the grain (for example, an internal latent image-type emulsion or a previously fogged direct reversal emulsion).

The photographic emulsion for use in the present invention can be prepared using the method described, for example, in P. Glafkides, Chimie et Physique Photographique, Paul Montel (1967), G. F. Duffin, Photographic Emulsion Chemistry, the Focal Press (1966), and V. L. Zelikman et al., Making and Coating Photographic Emulsion, the Focal Press (1964). More specifically, any of the methods such as acid process, neutral process and ammonia process may be used. As for the form of reacting a soluble halogen salt, any of the methods such as single jet method, double jet method and a combination thereof may be used. Furthermore, a method of forming grains in the presence of excess silver ion (so-called "reverse mixing method") may also be used. As one type of the double jet method, a method of keeping constant the pAg in the liquid phase where silver halide is produced, that is, so-called controlled double jet method, may also be used. According to this method, a silver halide emulsion having a regular crystalline form and a nearly uniform grain size can be obtained. Two or more kinds of silver halide emulsions prepared separately may be mixed and used.

In order to control the grain growth, a silver halide solvent such as ammonia, potassium rhodanate, ammonium rhodanate, thioether compound (see, for example, U.S. Pat. Nos. 3,271,157, 3,574,628, 3,704,130, 4,297,439 and 4,276,374), thione compound (see, for example JP-A-53-144319, JF-A-53-82408 and JP-A-55-77737) and amine compound (see, for example, JP-A-54-100717) may be used at the formation of silver halide grains.

During formation or physical ripening of silver halide grains, a cadmium salt, a zinc salt, a thallium salt, an iridium salt or its complex salt, a rhodium salt or its complex salt, an iron salt or an iron complex salt, or the like may be present together. Examples of the internal latent image-type emulsion for use in the present invention include an emulsion having incorporated thereinto a dissimilar metal described in U.S. Pat. Nos. 2,592,250, 3,206,313, 3,447,927, 3,761,276 and 3,935,014.

In general, the silver halide emulsion is chemically sensitized. For the chemical sensitization, a method described, for example, in H. Frieser, Die Grundklagendor Photographischen Prozesse mit Silber halogenlden, Akademische Verlagegegellschaft, pp. 675-734 (1968) can be used. That is, for example, a sulfur sensitization method using a compound containing sulfur capable of reacting with active gelatin or silver (e.g., thiosulfates, thioureas, mercapto compounds, rhodanines); a reduction sensitization method using a reducing substance (e.g., stannous salt, amines, hydrazine derivative, formamidinesulfinic acid, silane compound), and a noble metal sensitization method using a noble metal compound (e.g., gold complex salt, complex salt of a metal belonging to Group VIII of the Periodic Table such as Pt, Rh, Ir and Pd) may be used individually or in combination.

Specific examples of the chemical sensitizer include a sulfur sensitizer such as allylthiocarbamide, thiourea, sodium thiosulfate and cystine; a noble metal sensitizer such as potassium chloroaurate, aurous thiosulfate and potassium chloroparadate; and a reduction sensitizer such as tin chloride, phenylhydrazine and reductone. Use of a selenium sensitizer is also useful. The selenium compound includes a labile selenium compound and/or a non-labile selenium compound and is used by stirring the emulsion at a high temperature, preferably at 40° C. or more, for a predetermined time period. As for the labile selenium compound, compounds described, for example, in JP-B-44-15748 (the term "JP-B" as used herein means an "examined Japanese patent publication"), JP-B-43-13489, and Japanese Patent Application Nos. 2-130976 and 2-229300 may be preferably used. Specific examples of the labile selenium sensitizer include isoselenocyanates (for example, aliphatic isoselenocyanates such as allyl isoselenocyanate), selenoureas, selenoketones, selenoamides, selenocarboxylic acids (e.g., 2-selenopropionic acid, 2-selenoacetic acid), selenoesters, diacyl selenides (e.g., bis(3-chloro-2,6-dimethoxybenzoyl) selenide), selenophosphates, phosphine selenides and colloidal metal selenium. Preferred categories of the labile selenium compound are described above but the present invention is not limited thereto. With respect to the labile selenium compound as a sensitizer for the photographic emulsion, it is generally understood by one skilled in the art that the structure of the compound is not so much important as long as the selenium is labile and that the organic moiety of the selenium sensitizer molecule plays no part other than to carry selenium and allow the selenium in the labile form to be present in emulsion. In the present invention, a labile selenium compound in such a wide concept is advantageously used. Examples of the non-labile selenium compound include compounds described in JP-B-46-4553, JP-B-52-34492 and JP-B-52-34491, such as selenious acid, potassium selenocyanate, selenazoles, quaternary salt of selenazoles, diaryl selenide, diaryl diselenide, dialkyl selenide, dialkyl diselenide, 2-selenazolidinedione, 2-selenooxazolidine-thione, and derivatives thereof. Furthermore, a sensitizer such as polyoxyethylene compound, polyoxypropylene compound and quaternary ammonium group-containing compound, may also be contained.

The photographic emulsion may contain various compounds for the purpose of preventing fogging during production, storage or photographic processing of the light-sensitive material or stabilizing the photographic performance. That is, there may be added many compounds known as an antifoggant or stabilizer, for example, azoles such as benzothiazolium salts, nitroindazoles, triazoles, benzotriazoles and benzimidazoles (particularly, nitro or halogen substitution); heterocyclic mercapto compounds such as mercaptothiazoles, mercaptobenzothiazoles, mercaptobenzimidazoles, mercaptothiadiazoles, mercaptotetrazoles (particularly, 1-phenyl-5-mercaptotetrazole) and mercaptopyrimidines; the above-described heterocyclic mercapto compounds, which have a water-soluble group such as carboxyl group or sulfone group; thioketo compounds such as oxazolinethion; azaindenes such as tetrazaindenes (particularly, 4-hydroxy substituted (1,3,3a,7)tetrazaindenes); benzenethiosulfonic acids; and benzenesulfinic acids.

For the purpose of enhancing the dimensional stability of photographic material or improving the physical properties of film, the silver halide emulsion may contain a polymer latex comprising a homopolymer or copolymer of alkyl acrylate, alkyl methacrylate, acrylic acid, glycidyl acrylate or the like described in U.S. Pat. Nos. 3,411,911, 3,411,912, 3,142,568, 3,325,286 and 3,547,650 and JP-B-45-5331.

In the case of using the silver halide emulsion as a lith-type light-sensitive material for printing, a polyalkylene oxide compound may be used for enhancing the infectious development effect. Examples of the compound which can be used include those described in U.S. Pat. Nos. 2,400,532, 3,294,537 and 3,294,540, French Patents 1,491,805 and 1,596,673, JP-B-40-234466, JP-A-60-156423, JP-A-54-18726 and JP-A-56-161933. Preferred examples thereof include a condensate of an alkylene oxide having a carbon number of 2 to 4 (e.g., ethylene oxide, propylene-1,2-oxide, butylene-1,2-oxide), preferably a polyalkylene oxide composed of at least 10 ethylene oxide units, with a compound having at least one active hydrogen atom, such as water, aliphatic alcohol, aromatic alcohol, fatty acid, organic amine and hexitol derivative; and a block copolymer of at least two kinds of polyalkylene oxides. Specific examples of the polyalkylene oxide compound include polyalkylene glycol alkyl ethers, polyalkylene glycol aryl ethers, polyalkylene glycol alkylaryl ethers, polyalkylene glycol esters, polyalkylene glycol aliphatic amides, polyalkylene glycol amines, polyalkylene glycol block copolymers and polyalkylene glycol graft polymers. The polyalkylene oxide compound which can be used has a molecular weight of 300 to 15,000, preferably 600 to 8,000. The amount of the polyalkylene oxide compound added is preferably from 10 mg to 3 g per mol of the silver halide. As for the addition timing, an arbitrary timing in the production process may be selected.

The silver halide photographic emulsion for use in the present invention may contain a color coupler such as cyan coupler, magenta coupler and yellow coupler, and a compound for dispersing the coupler therein. That is, the silver halide photographic emulsion may contain a compound capable of forming a color by oxidation coupling with an aromatic primary amine developer (e.g., phenylenediamine derivative, aminophenol derivative) in the color development processing. Examples of the compound include, as the magenta coupler, a 5-pyrazolone coupler, a pyrazolobenzimidazole coupler, a cyanoacetylcoumarone coupler and an open-chain acylacetonitrile coupler; as the yellow coupler, an acylacetamide coupler (e.g. benzoylacetanilides, pivaloylacetanilides); and, as the cyan coupler, a naphthol coupler and a phenol couplers. Such a coupler is preferably a non-diffusive coupler having a hydrophobic group called a ballast group in the molecule. The coupler may be either four-equivalent or two-equivalent to silver ion. Also, the coupler may be a colored coupler having a color-correcting effect, or a coupler which releases a development inhibitor along with the development (so-called DIR coupler). Other than the DIR coupler, the silver halide emulsion may contain a non-color-forming DIR coupling compound that gives a colorless product by coupling reaction and releases a development inhibitor.

The silver halide emulsion may contain a water-soluble dye (e.g., oxonol dye, hemioxonol dye, merocyanine dye) as a filter dye or for the purpose of preventing irradiation or other various purposes.

The silver halide emulsion may contain various surfactants for various purposes, for example, for aiding the coating, imparting an antistatic property, improving slipperiness, effecting emulsion dispersion, preventing adhesion or enhancing photographic properties (e.g., promotion of development, elevation of contrast, increase of sensitivity). Examples of the surfactant which can be used include a nonionic surfactant such as saponin (steroid type), alkylene oxide derivative (e.g., polyethylene glycol), polyethylene glycol alkyl ethers, glycidol derivative, aliphatic esters of polyhydric alcohol, and alkyl esters of sugar; an anionic surfactant such as alkyl carboxylate, alkyl sulfonate, alkylbenzene sulfonate and alkyl sulfuric esters; and a cationic surfactant such as alkylamine salts, aliphatic or aromatic quaternary ammonium salts and heterocyclic quaternary ammonium salts (e.g., pyridinium, imidazolium). In the case of using the surfactant for imparting an antistatic property, a fluorine-containing surfactant is preferred.

In practicing the present invention, the following known discoloration inhibitor may be used in combination. Also, as regards the color image stabilizer for use in the present invention, one species may be used alone or two or more species may be used in combination. Examples of the known discoloration inhibitor include hydroquinone derivatives, gallic acid derivatives, p-alkoxyphenols, p-oxyphenol derivatives and bisphenols.

The photographic emulsion may contain an inorganic or organic hardening agent. For example, a chromium salt (e.g., chromium alum, chromium acetate), aldehydes (e.g., formaldehyde, glyoxal, glutaraldehyde), an active vinyl compound (e.g., 1,3,4-triacryloyl-hexahydro-s-triazine, 1,3-vinylsulfonyl-2-propanol) and an active halogen compound (e.g., 2,4-dichloro-6-hydroxy-s-triazine) may be used individually or in combination.

The silver halide photographic light-sensitive material of the present invention may contain a color fogging inhibitor such as hydroquinone derivative, aminophenol derivative and gallic acid derivative.

In the light-sensitive material of the present invention, colloidal silver or a dye is used for preventing irradiation or halation, particularly, for ensuring separation of spectral sensitivity distribution of each light-sensitive layer as well as immunity to safelight. Examples of the dye include oxonol dyes having a pyrazolone nucleus, a barbituric nucleus or a barbituric acid nucleus described in U.S. Pat. Nos. 506,385, 1,177,429, 1,131,844, 1,338,799, 1,385,371, 1,467,214, 1,438,102 and 1,533,516, JP-A-48-85130, JP-A-49-114420, JP-A-52-117123, JP-A-55-161213, JP-A-59-111640, JP-B-39-22069, JP-B-43-13168, JP-B-62-273527, and U.S. Pat. Nos. 3,247,127, 3,469,985 and 4,078,933; other oxonol dyes described in U.S. Pat. Nos. 2,533,472 and 3,7379,533, British Patent 1,278,621, JP-A-1-134447 and JP-A-1-183652; azo dyes described in British Patents 575,691, 680,631, 599,623, 786,907, 907,125 and 1,045,609, U.S. Pat. No. 4,255,326 and JP-B-59-211043; azomethine dyes described in JP-A-50-100116, JP-A-54-118247, and British Patents 2,014,598 and 750,031; anthraquinone dyes described in U.S. Pat. No. 2,865,752; arylidene dyes described in U.S. Pat. Nos. 2,538,009, 2,668,541 and 2,538,008, British Patents 584,609 and 1,210,252, JP-A-50-40625, JP-A-51-3623, JP-A-51-10927, JP-A-54-118247, JP-B-48-3286 and JP-B-59-37303; styryl dyes described in JP-B-28-3082, JP-B-44-16594 and JP-B-59-28898; triarylmethane dyes described in British Patents 446,538 and 1,335,422, and JP-A-59-288250, merocyanine dyes described in British Patents 1,075,653, 1,153,341, 1,284,730, 1,475,228 and 1,542,807; and cyanine dyes described in U.S. Pat. Nos. 2,843,486 and 3,294,539, and JP-A-1-291247. The methine compound of the present invention can be used as the dye and this is advantageous in that the dye can be easily decolorized.

In order to prevent diffusion of such a dye, the following methods may be employed. For example, the dye is made non-diffusive by incorporating a ballast group thereinto. Also, for example, a method where a hydrophilic polymer having an electric charge opposite that of the dissociated anionic dye is allowed to coexist as a mordant in the layer and interact with the dye molecule, thereby localizing the dye in a specific layer, is disclosed in U.S. Pat. Nos. 2,548,564, 4,124,396 and 3,625,694; a method where a specific layer is dyed using a fine metal salt particle having adsorbed thereto a dye is disclosed in U.S. Pat. Nos. 2,719,088, 2,496,841, 2,496,843, and JP-A-60-45237; and a method where a specific layer is dyed using a solid dispersion of water-insoluble dye is disclosed in JP-A-56-12639, JP-A-55-155350, JP-A-55-155351, JP-A-63-27832, JP-A 63-197943, and European Patent 15,601.

In the present invention, the dye in the form of a fine solid particle dispersion is contained in the silver halide emulsion layer and/or other hydrophilic colloid layers for the purpose of preventing halation or irradiation or enhancing safelight immunity or front/back discrimination and therefore, this dye needs to satisfy the following conditions:

(1) to have a proper spectral absorption according to the intended use;

(2) to be photochemically inactive, that is, not to give an adverse chemical effect such as decrease of sensitivity, regression of latent image, and fogging, on the performance of silver halide photographic emulsion layer;

(3) not to leave harmful coloring on the processed photographic light-sensitive material by decolorizing during photographic processing or by dissolving out in the processing solution or washing water;

(4) not to diffuse from the dyed layer to other layers; and (5) to exhibit excellent stability with aging in a solution or a photographic material and be free from discoloration or fading.

As for the dye satisfying these conditions, solid-dispersed dyes described in JP-A-56-12639, JP-A-55-155350, JP-A-55-155351, JP-A-63-27838, JP-A-63-197943, European Patents 15,601, 274,723, 276,566 and 299,435, International Publication (WO)88/04794, Japanese Patent Application No. 1-87367 and JP-A-4-14035 can be used.

Specific examples of the dye which can be used in the present invention are set forth below.

S-1

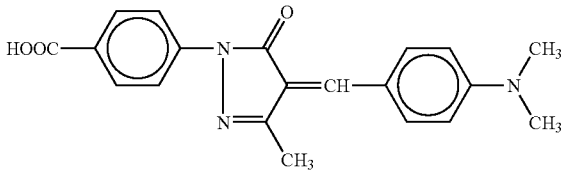

S-2

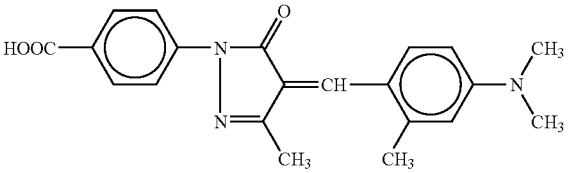

-continued
S-3
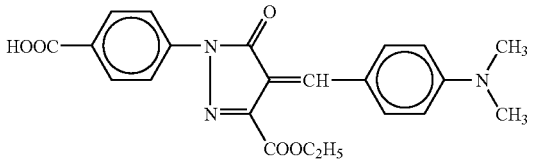
S-4
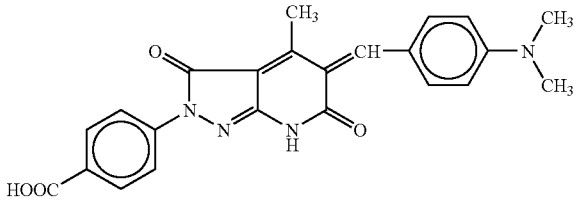
S-5
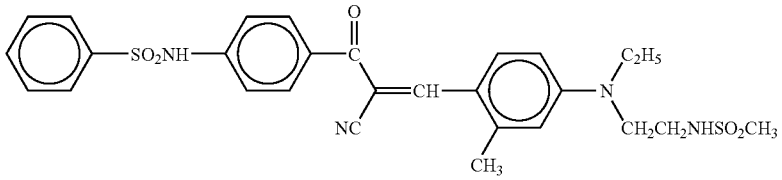
S-6
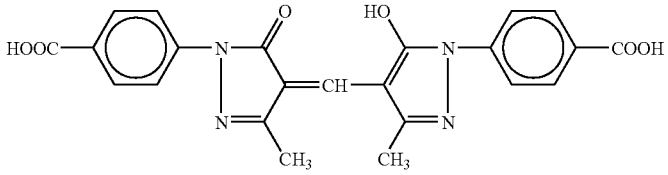
S-7
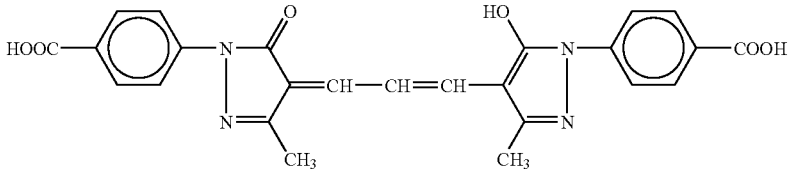
S-8
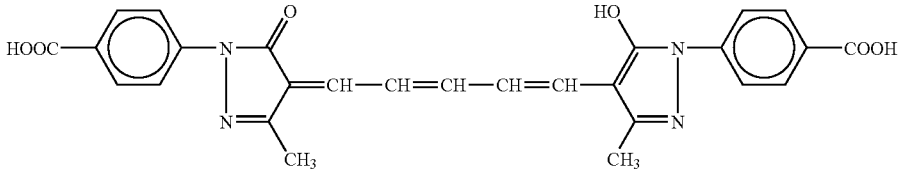
S-9
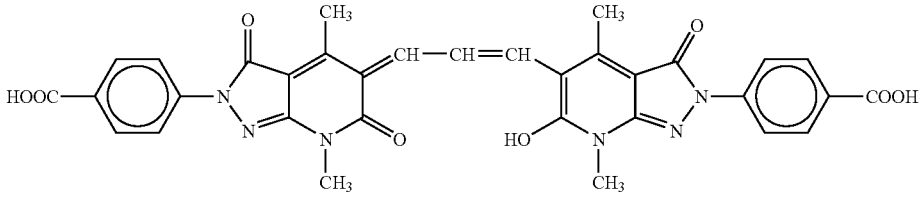
S-10
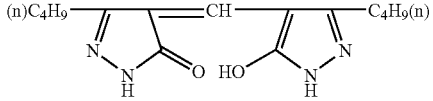
S-11
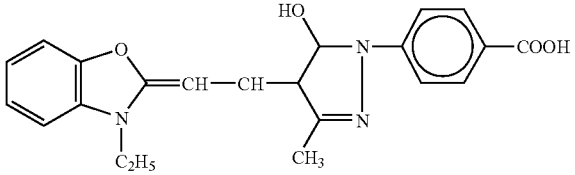

-continued

S-12

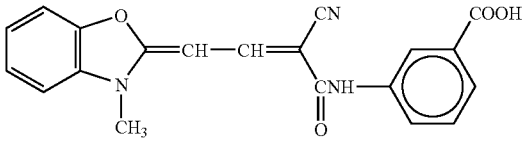

S-13

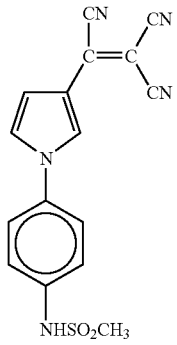

S-14

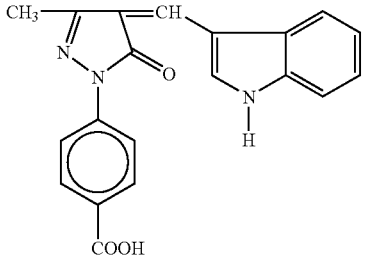

S-15

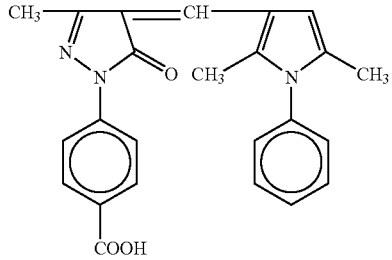

S-16

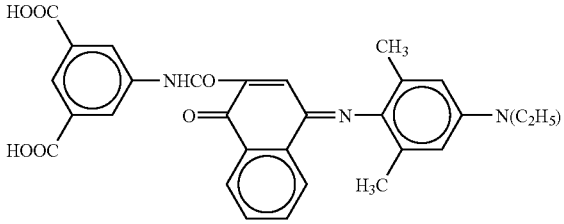

The dye for use in the present invention can be easily produced by or in accordance with the method described, for example, in International Publication WO88/04794, EP-A1-0274723, EP-A-276566, EP-A-299435, JP-A-52-92716, JP-A-55-155350, JP-A-55-155351, JP-A-61-205934, JP-A-48-68623, U.S. Pat. Nos. 2,527,583, 3,486,897, 3,746,539, 3,933,798, 4,130,429 and 4,040,841, and Japanese Patent Application Nos. 1-50874, 1-103751 and 1-307363. The term "fine crystal dispersion" as used in the present invention means that the dye itself is insufficient in the solubility and unable to exist in the molecular state in the objective colored layer but is present as a solid substantially in a size not to allow for diffusion in the layer. The preparation method is described, for example, in International Publication WO88/04794, EP-A1-0276566 and JP-A-63-197943, but in general, the dye is ground in a ball mill and stabilized with a surfactant and gelatin.

The dye in the dispersion for use in the present invention exists as a fine solid having an average particle size of 0.1 to 0.6 μm and a coefficient of variation in the particle size distribution of 50% or less. Here, a dye having an average particle size of 0.1 to 0.5 μm is particularly preferred, and a dye dispersion having an average particle size of 0.1 to 0.5 μm and a coefficient of variation of 35% or less is more preferred. The coefficient of variation is expressed by a value (S/d) obtained by dividing the standard deviation (S) by the average diameter (d) in the distribution of equivalent-circle diameter based on the projected area. The amount of the dye used is preferably from 5 to 300 mg/m$^2$, more preferably from 10 to 150 mg/m$^2$. In the case of using the solid dye dispersion as a filter dye or an antihalation dye, the dye may be used in an arbitrary effective amount but is preferably used to give an optical density of 0.05 to 3.5. The timing for addition may be at any step before coating.

In the silver halide photographic light-sensitive material of the present invention, a protective layer is preferably provided on the above-described emulsion layer coated on a support. Also, a back layer may be provided on the back side (the side not having the emulsion layer) of the support. The silver halide photographic light-sensitive material may take a construction consisting of a back layer, a support, an antihalation layer, an emulsion layer, an interlayer, an ultraviolet absorbing layer and a protective layer. In the case of using a coloring matter or dye in such a layer, the methine compound of the present invention is preferably used because of its easy decolorization.

The silver halide photographic emulsion for use in the present invention may contain, as a protective colloid, gelatin; an acylated gelatin such as phthalated gelatin and malonated gelatin; a cellulose compound such as hydroxyethyl cellulose and carboxymethyl cellulose; a soluble starch such as dextrin; a hydrophilic polymer such as polyvinyl alcohol, polyvinylpyrrolidone, polyacrylamide and polystyrenesulfonic acid; a plasticizer for dimensional stabilization; a latex polymer; and a matting agent. A finished emulsion is coated on an appropriate support such as baryta paper, resin-coated paper, synthetic paper, triacetate film, polyethylene terephthalate film, polyethylene naphthalate film, other plastic bases and glass plate.

The exposure for obtaining a photographic image may be performed by an ordinary method. More specifically, various known light sources such as natural light (sunlight), tungsten lamp, mercury lamp, xenon arc lamp, carbon arc lamp, xenon flash lamp, laser, LED and CRT, all may be used. The exposure time may be of course from 1/1000 to 1 second as employed for an ordinary camera or may be shorter than 1/1000 second, for example, an exposure time of $1/10^4$ to $1/10^8$ second with use of a xenon fluorescent lamp or an exposure time longer than 1 second may be used. If desired, the spectral composition of light used for exposure may be controlled using a color filter. Laser light may also be used for exposure. Furthermore, exposure may be performed using light emitted from a fluorescent substance excited by electron beam, X-ray, γ ray, α ray or the like. The exposure is preferably performed using a tungsten light source for 1/5 to 1 second.

The silver halide photographic light-sensitive material of the present invention is not particularly limited in its exposure method as long as the usage is for the preparation of movie subtitles, but it is preferred that two sheets, that is, the silver halide photographic light-sensitive material of the present invention after development and an intermediate light-sensitive material bearing image information, are stacked and subjected to contact exposure with a cinematic positive light-sensitive material. As regards the printer used at the exposure, there may be, for example, a method of exposing the light-sensitive material to a tungsten light source by using a Model C printer manufactured by Bell & Howell, but the present invention is not limited thereto.

For the photographic processing of the light-sensitive material of the present invention, known methods described in Research Disclosure, No. 176, pp. 28-30 (RD-17643) may be utilized, and known processing solutions may be used therefor. The processing temperature is usually set between 18° C. and 50° C. but may be a temperature lower than 18° C. or higher than 50° C. According to the purpose, either development processing of forming a silver image (black-and-white photographic processing) or color photo-graphic processing comprising development required to form a dye image may be applied.

In the black-and-white developer, known developing agents such as dihydroxybenzenes (e.g., hydroquinone), 3-pyrazolidones (e.g., 1-phenyl-3-pyrazolidone) and aminophenols (e.g., N-methyl-p-aminophenol) may be used individually or in combination. The color developer generally comprises an aqueous alkaline solution containing a color developing agent. As for the color developing agent, a known primary aromatic amine developing agent such as phenylenediamines (e.g., 4-amino-N-diethylaniline, 3-methyl-4-amino-N,N-diethylaniline, 4-amino-N-ethyl-N-p-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-β-methoxyethylaniline) may be used.

In addition, those described, for example, in L. F. A. Mason, Photographic Processing Chemistry, pp. 226-229, the Focal Press (1966), U.S. Pat. Nos. 2,193,015 and 2,592,364, and JP-A-48-64933 may be used. The developer may further contain a pH buffering agent such as alkali metal sulfite, carbonate, borate and phosphate, and a development inhibitor or antifoggant such as bromide and organic antifoggant. Ir desired, the developer may contain, for example, a hard water softening agent, a preservative such as hydroxylamine, an organic solvent such as benzyl alcohol and diethylene glycol, a development accelerator such as polyethylene glycol, quaternary ammonium salt and amines, a coloring matter-forming coupler, a competing coupler, a fogging agent such as sodium boron hydride, an auxiliary developing agent such as 1-phenyl-3-pyrazolidone, a tackifier, a polycarboxylic acid-based chelating agent described in U.S. Pat. No. 4,083,723, and an antioxidant described in West German Patent (OLS) No. 2,622,950.

When color photographic processing is applied, the photographic light-sensitive material after color development is usually bleached. The bleaching may be performed simultaneously with fixing or these treatments may be performed individually. As regards the bleaching agent, for example, compounds of polyvalent metal such as iron(III), cobalt(III), chromium(VI) and copper(II), peracids, quinones and nitroso compounds may be used. Examples thereof include a ferricyanide, a bichromate, an organic complex salt of iron(III) or cobalt(III), a complex salt of aminopolycarboxylic acids such as ethylenediaminetetraacetate, nitrotriacetic acid and 1,3-diamino-2-propanoltetraacetic acid, a complex salt of organic acids such as citric acid, tartaric acid and malic acid, a persulfate, a permanganate and a nitrosophenol. Among these, potassium ferricyanide, sodium iron(III) ethylenediaminetetraacetate and ammonium iron(III) ethylenediaminetetraacetate are particularly useful. An ethylenediamine-tetraacetic acid iron (III) complex salt is useful in both an independent bleaching solution and a mono-bath bleach-fixing solution. In the bleaching or bleach-fixing solution, bleaching accelerators described in U.S. Pat. Nos. 3,042,520 and 3,241,966, JP-B-45-8506 and JP-B-45-8836, thiol compounds described in JP-A-53-65732, and other various additives may be added. After bleaching or bleach fixing, the photographic light-sensitive material may be subjected to water washing, or only a treatment in a stabilization bath may be performed.

As for the development processing, the processing described in "Processing KODAK Motion Picture Films, Module 15, Processing Black-and-White Films" of H-24 Processing Modules for Motion Picture Films is most preferred.

Various additives, the development processing method and the like used for the light-sensitive material of the present invention are not particularly limited and, for example, those described in the following portions may be preferably used.

TABLE 1

| Item | Pertinent Portion |
|---|---|
| 1) Silver halide emulsion and production process thereof | JP-A-2-97937, from page 20, right lower column, line 12 to page 21, left lower column, line 14; JP-A-2-12236, from page 7, right upper column, line 19 to page 8, left lower column, line 12; and the selenium sensitization method described in Japanese Patent Application No. 3-189532 |
| 2) Spectral sensitizing dye (a plurality of spectral sensitizing dyes may be used in combination) | JP-A-2-55349, from page 7, left upper column, line 8 to page 8, right lower column, line 8; JP-A-2-39042, from page 7, right lower column, line 8 to page 13, right lower column, line 5; JP-A-2-12236, page 8, from left lower column, line 13 to right lower column, line 4; JP-A-2-103536, from page 16, right lower column, line 3 to page 17, left lower |

TABLE 1-continued

| Item | Pertinent Portion |
|---|---|
| | column, line 20; JP-A-1-112235, JP-A-2-124560, JP-A-3-7928, and Japanese Patent Application Nos. 3-189532 and 3-411064 |
| 3) Hydrazine nucleating agent | JP-A-2-12236, from page 2, right upper column, line 19 to page 7, right upper column, line 3; and JP-A-3-174143, from page 20, right lower column, line 1 to page 27, right upper column, line 20 (formula (II) and Compounds (II-1) to (II-54)) |
| 4) Nucleation Accelerator | JP-A-2-103536, from page 9, right upper column, line 13 to page 16, left upper column, line 10 (formulae (II-m) to (II-p) and Compounds (II-1) to (II-22)); JP-A-1-179939 |

TABLE 2

| Item | Pertinent Portion |
|---|---|
| 5) Surfactant | JP-A-2-12236, page 9, from right upper column, line 7 to right lower column, line 7; JP-A-2-18542, from page 2, left lower column, line 13 to page 4, right lower column, line 18 |
| 6) Antifoggant | JP-A-2-103536, from page 17, right lower column, line 19 to page 18, right upper column, line 4, and page 18, right lower column, lines 1 to 5; and thiosulfinic acid compounds described in JP-A-1-237538 |
| 7) Polymer latex | JP-A-2-103536, page 18, left lower column, lines 12 to 20 |
| 8) Compound having acid group | JP-A-2-103536, from page 18, right lower column, line 6 to page 19, left upper column, line 1 |
| 9) Matting agent, lubricant and plasticizer | JP-A-2-103536, page 19, from left upper column, line 15 to right upper column, line 15 |
| 10) Polyhydroxybenzenes | JP-A-2-55349, page 11, from left upper column, line 9 to right lower column, line 17 |
| 11) Compound having acid group | JP-A-2-103536, from page 18, right lower column, line 6 to page 19, left upper column, line 1; JP-A-2-55349, from page 8, right lower column, line 13 to page 11, left upper column, line 8 |
| 12) Dye | JP-A-2-103536, page 17, right lower column, lines 1 to 18; JP-A-2-39042, from page 4, right upper column, line 1 to page 6, right upper column, line 5 |
| 13) Binder | JP-A-2-18542, page 3, right lower column, lines 1 to 20 |

TABLE 3

| Item | Pertinent Portion |
|---|---|
| 14) Black rash inhibitor | Compounds described in U.S. Pat. No. 4,956,257 and JP-A-1-118832 |
| 15) Redox compound | Compound represented by formula (I) of JP-A-2-301743 (particularly, Compounds 1 to 50); formulae (R-1), (R-2) and (R-3) and Compounds 1 to 75 of JP-A-3-174143, pages 3 to 20; and compounds described in Japanese Patent Application Nos. 3-69466 and 3-15648 |
| 16) Monomethine compound | Compound of formula (II) of JP-A-2-287532 (particularly, Compounds II-1 to II-26) |
| 17) Dihydroxybenzenes | Compounds described in JP-A-3-39948, from page 11, left upper column to page 12, left lower column, and EP-A-452772 |
| 18) Developer and developing method | JP-A-2-103536, from page 19, right upper column, line 16 to page 21, left upper column, line 8; JP-A-2-55349, from page 13, right lower column, line 1 to page 16, left upper column, line 10 |

The present invention is described in greater detail below by referring to Examples.

EXAMPLES

Example 1

Preparation of Emulsion:

Solution 2 and Solution 3 shown in Table 4 were simultaneously added with stirring over 5 minutes to Solution 1 kept at 64° C., and subsequently, Solution 4, Solution 5 and Solution 6 shown in Table 4 were added thereto over 40 minutes while controlling the pAg to 7.8. Finally, a monodisperse cubic silver iodobromide emulsion having an average grain size of 0.25 μm and an average iodide content of 1 mol % was obtained (coefficient of variation: 8%). The emulsion was then washed with water by the flocculation method in a usual manner, gelatin was added thereto, and the pH and pAg were adjusted to 6.8 and 8.0, respectively. Thereafter, 13.8 mg of sodium thiosulfate, 4.6 mg of chloroauric acid, 17 mg of potassium thiocyanate and 6.5 mg of benzenethiosulfonic acid were added, and the emulsion was chemically sensitized at 65° C. to have optimal sensitivity. Furthermore, 75 mg of 2-methyl-4-hydroxy-1,3,3a,7-tetrazaindene as a stabilizer and 2 g of phenoxyethanol as an antiseptic were added to obtain silver Iodobromide Cubic Emulsion A.

TABLE 4

(Solution 1)

| | |
|---|---|
| Gelatin | 20 g |
| Potassium bromide | 3 g |
| Benzenethiosulfonic acid | 5 mg |
| 1,3-Dimethylimidazolidine-2-thione | 6 mg |
| Water added to make | 900 ml |

TABLE 4-continued

| | |
|---|---|
| (Solution 2) | |
| Silver nitrate | 18.9 g |
| Water added to make | 85 ml |
| (Solution 3) | |
| Potassium bromide | 13.9 g |
| Water added to make | 60 ml |
| (Solution 4) | |
| Silver nitrate | 151 g |
| Water added to make | 680 ml |
| (Solution 5) | |
| Potassium bromide | 106 g |
| Potassium iodide | 1.5 g |
| Water added to make | 455 ml |

Preparation of Coated Sample 100:

To Emulsion A, a sensitizing dye (Compound D) was added in an amount of $5\times10^{-4}$ mol/Ag—mol, and 100 mg of Compound 1, 29 mg of 1-phenyl-5-mercaptotetrazole, 10 mg of sodium 3-(5-mercaptotetrazole)benzenesulfonate, 2.5 g of 4-hydroxy-6-methyl-1,3,3a,7-tetrazaindene and 0.8 g of potassium bromide were further added. After adjusting the pH to 5.5 by adding phosphoric acid, sodium polystyrenesulfonate as a thickener in an amount of 20 mg per g of gelatin, polyethyl acrylate latex (average particle size; 0.05 μm) as a plasticizer in an amount of 30 wt % based on gelatin, and 2-bis(vinylsulfonylacetamido)ethane as a hardening agent were added. The obtained solution was simultaneously coated together with the dyeing layer and protective layer shown below. Incidentally, the emulsion layer was coated to have a silver amount of 2.2 g/m$^2$, a gelatin amount of 1.9 g/m$^2$ and a hardening agent amount of 175 mg/m$^2$.

| | |
|---|---|
| Dyeing layer: | |
| Gelatin | 1.5 g/m$^2$ |
| * Solid Disperse Dye S-8 | 80 mg/m$^2$ |
| * Solid Disperse Dye S-10 | 30 mg/m$^2$ |
| Sodium polystyrenesulfonate | 25 mg/m$^2$ |
| Dye 1 | 40 mg/m$^2$ |
| Dye 2 | 8 mg/m$^2$ |
| Sodium dodecylbenzenesulfonate | 5 mg/m$^2$ |
| Phosphoric acid | 12 mg/m$^2$ |
| Antiseptic | 3 mg/m$^2$ |
| Protective Layer: | |
| Gelatin | 0.5 mg/m$^2$ |
| Compound 2 | 2 mg/m$^2$ |
| Compound 3 | 1 mg/m$^2$ |
| Sodium dodecylbenzenesulfonate | 2 mg/m$^2$ |
| Colloidal silica | 88 mg/m$^2$ |
| Compound 4 | 2 mg/m$^2$ |
| L-Ascorbic acid | 20 mg/m$^2$ |
| 1,5-Dihydroxy-2-benzaldoxime | 5 mg/m$^2$ |
| Sodium acetate | 100 mg/m$^2$ |
| Sodium polystyrenesulfonate | 15 mg/m$^2$ |
| Strontium sulfate | 30 mg/m$^2$ |
| Compound 5 | 17 mg/m$^2$ |
| Compound 6 | 6 mg/m$^2$ |
| Liquid paraffin | 40 mg/m$^2$ |
| Antiseptic | 2 mg/m$^2$ |

Compound 1:

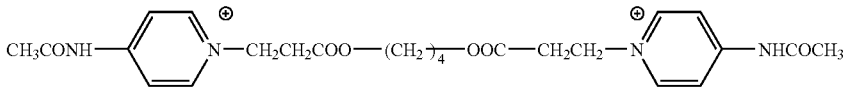

Dye 1:

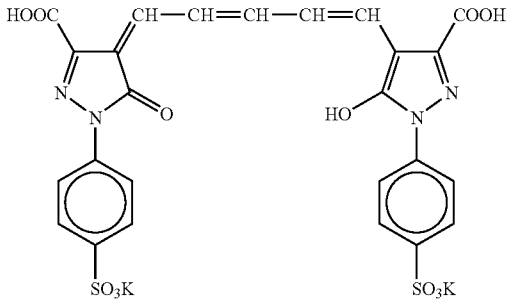

Dye 2:

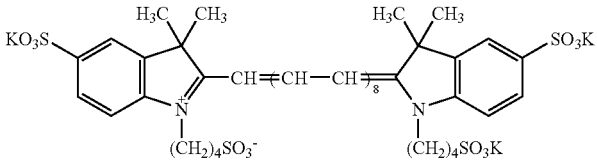

Compound 2:

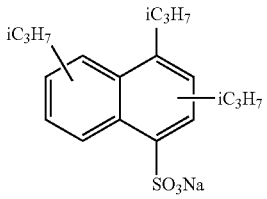

Compound 3:

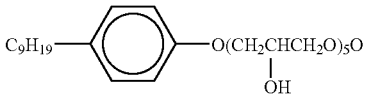

-continued

Compound 4:

A 1:1 (by weight) mixture of

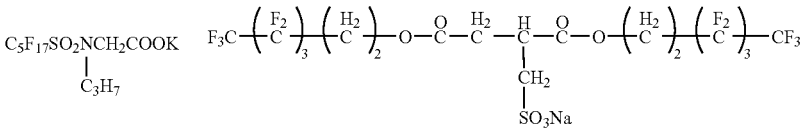

Compound 5:

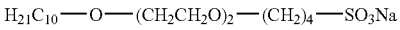

Compound 6:

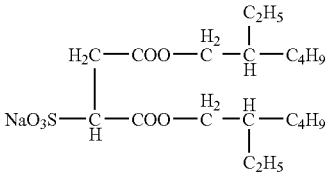

Compound D:

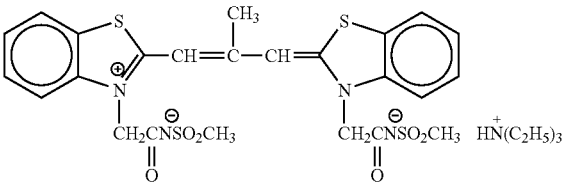

Preparation Method of * Solid Disperse Dye:

The preparation in the present invention was performed according to the method of JP-A-63-197943. More specifically, 434 ml of water and 53 g of a 6.7% solution of surfactant Triton X-200R (TX-200R, sold by Rohm & Haas Co.) were charged into a 1.5-liter bottle with a screw cap, 20 g of dye and 800 ml of zirconium ($ZrO_2$) beads (diameter: 2 mm) were added thereto, the bottle was capped tightly and placed in a mill, and the content was milled for 4 days. The resulting content was added to 160 g of an aqueous 12.5% gelatin solution and after standing in a roll mill for 10 minutes to decrease bubbles, the obtained mixture was filtered and the $ZrO_2$ beads were removed. In this state, the average grain size was 0.3 μm but coarse grains were still contained. Therefore, classification was then performed by centrifugation such that the maximum grain size became 1 μm or less.

Samples 101 to 109 prepared by coating the layers on a 125 βm-thick cellulose triacetate transparent support in the same manner as Sample 100 except that the silicone oil species (produced by Shin-Etsu Chemical Co., Ltd.) in the coated amount shown in Table A was added to the protective layer. These coated Samples 100 to 109 were stored in a roll form under the conditions of 25° C. and 55% RH for 7 days, thereby film-hardening the gelatin binder.

<Measurement of Dynamic Friction Coefficient>

In order to evaluate the slipperiness of the samples above, the front and back surfaces of the coated material itself in the unexposed state were developed in a modified "FNCP300II" manufactured by Fujifilm Corp., and the dynamic friction coefficient μ on the front and back surfaces of the sample were measured. The dynamic friction coefficient was measured using a high-speed dynamic friction meter manufactured by Toyo Seiki Seisaku-Sho, Ltd. The sample was conveyed at 20 m/min and a relative value to SUS304 was determined. When the dynamic friction coefficient μ is low, this means that the sample is slippery and advantageous.

The results are shown in Table B.

Development Process

<Step>

| Name of Step | Processing Temperature (° C.) | Processing Time (sec) | Replenishing Amount (ml, per 35 mm × 30.48 m) |
|---|---|---|---|
| 1. Development | 21.0 ± 0.1 | 210 | 650 |
| 2. Water washing | 21 | 50 | 1200 |
| 3. Fixing | 21 | 360 | 600 |
| 4. Water washing | 21 | 600 | 1200 |
| 5. Drying | | | |

<Processing>

A composition per 1 liter is shown.

| Name of Step | Name of Chemical | Tank Solution | Replenisher |
|---|---|---|---|
| Development | Monol produced by Fujifilm Corp. | 0.5 g | 0.7 g |
| | Sodium sulfite | 40.0 g | 70.0 g |
| | Hydroquinone produced by Fujifilm Corp. | 3.0 g | 11.0 g |
| | Sodium carbonate | 20.0 g | 20.0 g |
| | Sodium bromide | 1.75 g | 1.30 g |
| | Sodium hydroxide | — | 2.0 g |
| Fixing | Sodium thiosulfate | 153.0 g | 153.0 g |
| | Sodium sulfite | 15.0 g | 15.0 g |
| | Acetic acid (28%) | 48.0 ml | 48.0 ml |
| | Boric acid | 7.5 g | 7.5 g |
| | Potassium alum | 15.0 g | 15.0 g |

TABLE A

| Sample No. | Silicon Oil Species | Coated Amount (mg/m$^2$) |
|---|---|---|
| 100 | — | 0 |
| 101 | KF96-10 | 6 |
| 102 | KF96-10 | 12 |
| 103 | KF96-10 | 25 |
| 104 | KF96-100 | 12 |
| 105 | KF96-100 | 25 |
| 106 | KF96-10/KF96-100 | 12/6 |
| 107 | KF50 | 12 |
| 108 | KF50 | 25 |
| 109 | KF96-10/KF50 | 12/6 |

TABLE B

| | Unprocessed Sample | | Sample After Development Processing | | |
|---|---|---|---|---|---|
| Sample No. | Emulsion Surface (front) | Back Surface (back) | Emulsion Surface (front) | Back Surface (back) | Remarks |
| 100 | 0.25 | 0.45 | 0.23 | 0.33 | Comparative Example |
| 101 | 0.17 | 0.25 | 0.15 | 0.21 | Invention |
| 102 | 0.13 | 0.18 | 0.13 | 0.18 | Invention |
| 103 | 0.10 | 0.15 | 0.11 | 0.15 | Invention |
| 104 | 0.15 | 0.22 | 0.17 | 0.20 | Invention |
| 105 | 0.13 | 0.21 | 0.15 | 0.18 | Invention |
| 106 | 0.09 | 0.13 | 0.10 | 0.13 | Invention |
| 107 | 0.17 | 0.29 | 0.18 | 0.28 | Invention |
| 108 | 0.15 | 0.26 | 0.16 | 0.25 | Invention |
| 109 | 0.12 | 0.16 | 0.13 | 0.17 | Invention |

It is seen from Table B that by the addition of a silicone oil to the protective layer, the slipperiness at the high-speed conveyance is greatly improved. The effect of KF96-10 is particularly great. When the effect is compared between KF96 Series and KF50 Series, the effect of KF96 Series is greater and the dimethyl silicone oil type has high effect.

<Measurement of High-Seed Conveyance Durability>

In order to verify that the low dynamic friction coefficient μ has an effect in view of actual performance, a test of actually preparing a developed cinematic positive light-sensitive material sample and examining the durability was performed. A character original plate (obtained by outputting a black print of "Fujifilm" in Ming font of 12 point on white A4-size paper) was photographed over 10 m to fill the entire photographing screen under the conditions of a shutter speed of 3 frames/sec, a 50-mm lens and f=5.6. The sample was then developed using a modified "FNCP300II" manufactured by Fujifilm Corp. to prepare a subtitle reversal original plate. This sample was exposure-printed and reversed on another same unexposed sample in the same length at 3 frames/sec to prepare a subtitle original plate. The obtained subtitle original plate and an intermediate film, FCI, produced by Fujifilm Corp., in an unexposed state and in a length of 10 m, were developed according to ECN-II, and the print was then exposed over 10,000 m at 180 ft/min on a cinematic positive film, ETERNA 3513-Di, produced by Fujifilm Corp. by using a printer for movie, "Model C", manufactured by Bell & Howell. The exposed sample was then developed according to ECP-II at a speed of 180 ft/min by an automatic developing machine manufactured by Ootomo Engineering, thereby printing the subtitle. Out of the thus-prepared cinematic positive subtitle print, the last-exposed 100 m was projected using a projector manufactured by CINEFORD, and sensory evaluation of the print streak corresponding to scratch was performed on a 5-grade scale. The completely scratch-free state was rated 5, and the hardly practicable level due to many scratches was rated 1. The results are shown in Table C.

TABLE C

| Sample No. | Print Streak | Remarks |
|---|---|---|
| 100 | 1 | Comparative Example |
| 101 | 4 | Invention |
| 102 | 5 | Invention |
| 103 | 5 | Invention |
| 104 | 3 | Invention |
| 105 | 4 | Invention |
| 106 | 5 | Invention |
| 107 | 3 | Invention |
| 108 | 3 | Invention |
| 109 | 4 | Invention |

As seen from Table C, when a silicone oil, particularly, KF96-10 is used, the print streak of the cinematic positive print is greatly reduced. Considering also the results in Table B, this is presumed to occur because the slipperiness on the back surface is improved.

Example 2

Samples having the same constructions as Samples 100 to 109 except that the base used for coating was changed from the 125 μm-thick cellulose triacetate transparent support to a 125-μm polyethylene naphthalate base having an electrically conducting layer and a protective layer according to the following formulations, were prepared and subjected to the same test as in Example 1, as a result, the same effects were obtained.

| | |
|---|---|
| (1) Electrically Conducting Layer | |
| Julymer ET410 (produced by Nihon Junyaku Co., Ltd.) (Polyacrylic acid ester) | 38 mg/m$^2$ |
| $SnO_2$/Sb (9/1 by weight, average particle size: 0.25 μm) | 216 mg/m$^2$ |
| Compound 7 | 5 mg/m$^2$ |
| Compound 8 | 5 mg/m$^2$ |
| (2) Protective Layer | |
| Chemipearl S120 (produced by Mitsui Petrochemical Industries, Ltd.) (aqueous dispersion of polyolefin) | 33 mg/m$^2$ |
| Snowtex C (produced by Nissan Chemicals Industries, Ltd.) | 17 mg/m$^2$ |
| Compound 7 | 5 mg/m$^2$ |
| Compound 9 | 5 mg/m$^2$ |
| Sodium polystyrenesulfonate | 2 mg/m$^2$ |

-continued

Compound 7:

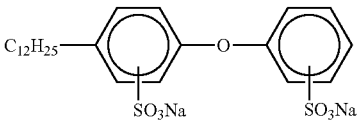

Compound 8:

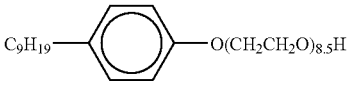

Compound 9:

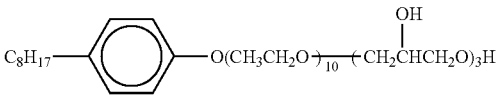

According to the present invention, a silver halide light-sensitive material for movie subtitles, assured of excellent durability not allowing for reflection of scratches at the preparation of a cinematic positive print, can be provided.

By practicing the present invention, an excellent effect can be created in the durability without causing reflection of scratches at the preparation of a cinematic positive print.

The entire disclosure of each and every foreign patent application from which the benefit of foreign priority has been claimed in the present application is incorporated herein by reference, as if fully set forth.

What is claimed is:

1. A silver halide photographic light-sensitive material for movie subtitles, comprising:

a transparent support; and at least one light-sensitive layer and at least one light-insensitive layer, directly or indirectly on the transparent support, wherein the at least one light-insensitive layer comprises at least one silicone oil.

2. The silver halide photographic light-sensitive material according to claim 1, wherein the silicone oil is a non-reactive silicone oil.

3. The silver halide photographic light-sensitive material according to claim 2, wherein the non-reactive silicone oil is a straight silicone oil.

4. The silver halide photographic light-sensitive material according to claim 3, wherein the straight silicone oil is at least one of a dimethyl silicone oil represented by formula (A) and a methylphenyl silicone oil represented by formula (B):

Formula (A):

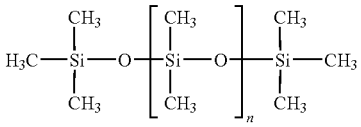

Formula (B):

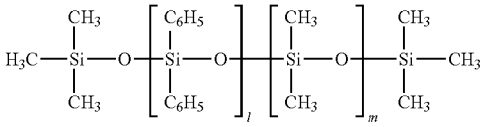

wherein n represents an integer of 1 or more; and 1 and m each independently represents an integer of 1 or more.

5. The silver halide photographic light-sensitive material according to claim 4, wherein the straight silicone oil is the dimethyl silicone oil represented by formula (A).

6. The silver halide photographic light-sensitive material according to claim 1, wherein a coated amount of the silicone oil is from 5 to 50 $mg/m^2$.

7. The silver halide photographic light-sensitive material according to claim 6, wherein the coated amount of the silicone oil is from 5 to 30 $mg/m^2$.

8. The silver halide photographic light-sensitive material according to claim 7, wherein the coated amount of the silicone oil is from 5 to 25 $mg/m^2$.

9. The silver halide photographic light-sensitive material according to claim 1, which has a total coated silver amount of from 1.70 to 2.50 $g/m^2$.

10. The silver halide photographic light-sensitive material according to claim 1, wherein the at least one light-insensitive layer comprising at least one silicone oil is a protective layer.

* * * * *